United States Patent [19]

Rekant

[11] 4,284,234

[45] Aug. 18, 1981

[54] CENTRIFUGE

[76] Inventor: Uriel Rekant, 22/5 Kovlosky St., Kiryat Herzog, Bnei Brak, Israel

[21] Appl. No.: 48,329

[22] Filed: Jun. 14, 1979

[30] Foreign Application Priority Data

Jun. 22, 1978 [IL] Israel ..... 54980

[51] Int. Cl.[3] ..... B04B 1/00; B04B 3/00

[52] U.S. Cl. ..... 233/27

[58] Field of Search ..... 233/27, 1 D, 11, 13, 233/DIG. 1, 7, 2, 12, 14 R, 28, 34, 38, 40, 45, 46

[56] References Cited

U.S. PATENT DOCUMENTS

| | | | |
|---|---|---|---|
| 2,733,855 | 2/1956 | McCoy | 233/27 X |
| 3,430,850 | 3/1969 | Gilreath | 233/7 |
| 3,674,206 | 7/1972 | Wendt, Jr. | 233/47 R X |
| 3,685,721 | 8/1972 | Kohama | 233/28 X |
| 3,960,319 | 6/1976 | Brown | 233/27 X |
| 3,998,610 | 12/1976 | Leith | 233/27 X |

*Primary Examiner*—Stanley N. Gilreath
*Attorney, Agent, or Firm*—Lawrence Rosen

[57] ABSTRACT

A centrifuge for treatment of fluids is provided. The centrifuge comprises a stationary vessel, a stationary pipe passing through the stationary vessel, a baffle disk fixedly mounted on the stationary pipe, a rotating drum mounted on and rotatable about the stationary pipe inside the stationary vessel and divided by the baffle disk into an inlet chamber and an outlet chamber. The outlet chamber is provided with outlet means and further comprises drive means to impart a rotary motion to the drum. The stationary pipe is divided into two mutually sealed-off sections, an inlet section and an outlet section, both of which pipe sections are perforated over that part of their respective length, which is located within said rotating drum. The arrangement is such that upon the introduction of a multi-component fluid into the inlet section of the stationary pipe, the fluid disperses into the interior of the rotating drum through the perforations in the inlet sections and, being entrained by the inside surfaces of the rotating drum, the fluid is affected by centrifugal forces, due to which forces the heavier components of the fluid are caused to migrate toward the periphery of the drum to exit via the outlet means, while the lighter components of the fluid are displaced toward the perforations of the outlet section of the stationary pipe, through which perforations the lighter components are drawn into the outlet section to be removed therefrom.

8 Claims, 6 Drawing Figures

CENTRIFUGE

The present invention relates to a centrifuge for continuous filtration, separation and/or fractionation of fluids, i.e., of gases, liquids or mixed phases.

Centrifuging is a well-established method for the separation of mixture components of different specific gravities and is increasingly used not only in laboratories but in large-scale industrial processes, too. Known centrifuges are either of the batch type, i.e., they can only process a certain quantity of material at one time, after which they have to be stopped, the separated charge removed, and fresh material charged, before the centrifuge can be restarted, or of the continuous type, which is the type mostly used in industrial, as opposed to laboratory, applications. Those known continuous centrifuges, however, are rather complicated pieces of machinery and, consequently, very expensive. A further drawback of these known continuous centrifuges is their limited fractional efficiency, the limited reproducibility of their separation characteristics and the difficulty of controlling the output parameters. It is the object of the present invention to overcome these drawbacks and difficulties and to provide a centrifuge which is continuous in operation, of high fractional efficiency and reproducibility, easily controllable in all of its output parameters and extremely simple in construction.

This object is achieved by providing a centrifuge for treatment of fluids, comprising a stationary vessel, a stationary pipe passing through said stationary vessel, a baffle disk fixedly mounted on said stationary pipe, a rotating drum mounted on and rotatable about said stationary pipe inside said stationary vessel and divided by said baffle disk into an inlet chamber and an outlet chamber, which outlet chamber is provided with outlet means, further comprising drive means to impart a rotary motion to said drum, wherein said stationary pipe is divided into two mutually sealed-off sections, an inlet section and an outlet section, both of which pipe sections are perforated over that part of their respective length, which is located within said rotating drum, the arrangement being such that upon the introduction of a multicomponent fluid into the inlet section of said stationary pipe, said fluid disperses into the interior of said rotating drum through said perforations in said inlet sections and, being entrained by the inside surfaces of said rotating drum, said fluid is affected by centrifugal forces, due to which forces the heavier components of said fluid are caused to migrate toward the periphery of said drum to exit via said outlet means, while the lighter components of said fluid are displaced toward the perforations of the outlet section of said stationary pipe, through which perforations said lighter components are drawn into said outlet section to be removed therefrom.

While the invention will now be described in connection with certain preferred embodiments with reference to the following illustrative figures so that it may be more fully understood, it is not intended to limit the invention to these particular embodiments. On the contrary, it is intended to cover all alternatives, modifications and equivalent arrangements as may be included within the scope of the invention, as defined by the appended claims. It is stressed, however, that the particulars discussed are by way of example and for purposes of illustrative discussion only and are presented in the cause of providing what is believed to be the most useful and readily understood description of the principles and conceptual aspects of the invention. In this regard no attempt is made to show structural details of the system and its apparatus in more detail than is necessary for a fundamental understanding of the invention the description making apparent to those skilled in the art how the several forms of the invention may be embodied in practice.

Figure 1:
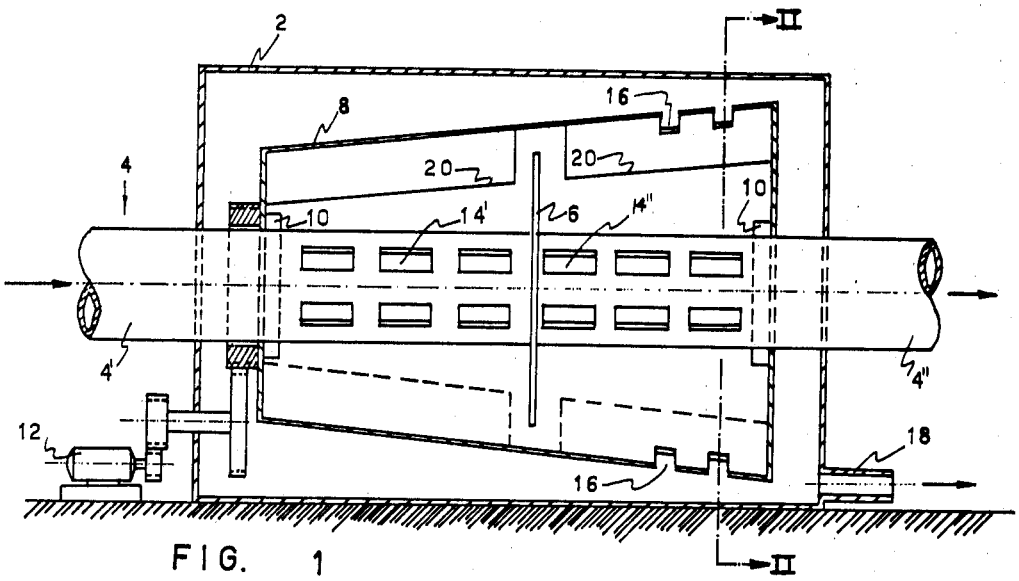
FIG. 1 is a longitudinal cross section of an embodiment of the centrifuge according to the present invention.
Figure 2:
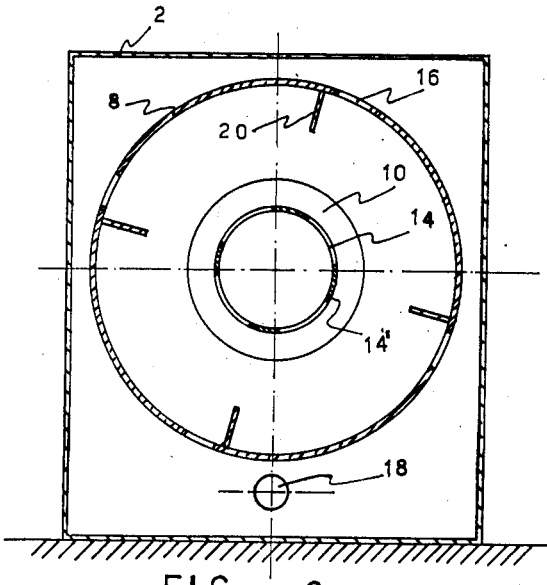
FIG. 2 represents a cross section, along the plane II—II in FIG. 1, of the embodiment shown in FIG. 1.

There is shown in FIG. 1 a preferred embodiment of the centrifuge according to the invention, comprising a stationary vessel 2, a stationary pipe 4 fixedly mounted in, and passing through, this vessel 2, a baffle disk 6 fixedly mounted on the stationary pipe 4, a rotatable, preferably truncated-cone-shaped drum 8 within the vessel 2 mounted on bearings 10 and rotating about the stationary pipe 4, as well as drive means 12 to impart a rotary motion to the drum 8. The stationary pipe 4 is divided into two mutually sealed-off sections, namely an inlet section 4' and an outlet section 4''. Over that part of their respective lengths which is located within the rotating drum 8, each of these pipe sections 4' and 4'' is provided with perforations 14' and 14'' respectively which, in the embodiment shown in FIG. 1, are rectangular, but which may be indeed of any convenient shape. A plurality of perforations 16 is also provided over a zone of the drum periphery close to that end of the drum 8 which is remote from the inlet section 4' of the stationary pipe 4. These perforations, too, may be of any convenient shape. For positive entrainment of the fluids introduced into the rotating drum 8, there is provided a plurality of vanes 20 attached to the inside wall of the drum 8 substantially along generatrices of the drum and extending into the drum 8 in a substantially radial direction. These vanes 20 are seen to better advantage in FIG. 2 which represents a cross section, along the plane II—II in FIG. 1, of the embodiment shown in FIG. 1.

Figure 3:
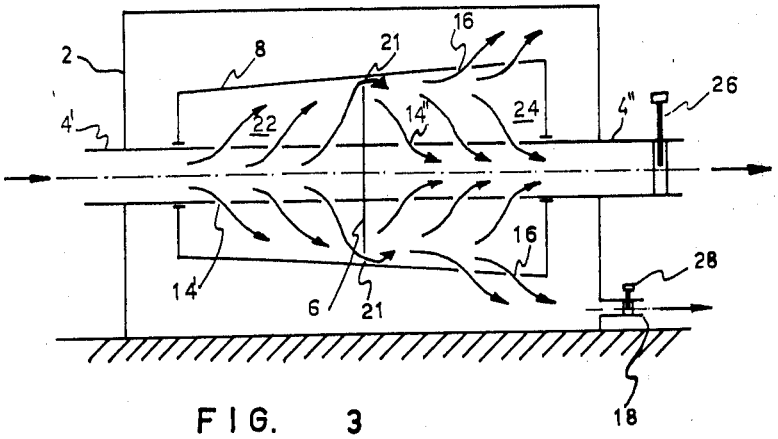
FIG. 3 is a schematic drawing of the centrifuge according to FIG. 1, showing the flow pattern of a fluid being treated.

FIG. 3 is a schematic drawing of the centrifuge according to FIG. 1, showing the flow pattern of a fluid being treated. The fluid is introduced into the inlet section 4' of the stationary pipe, whence it enters the interior of the rotating drum 8 via the perforations 14'. The baffle disk 6 divides the interior of the rotating drum 8 into two chambers, an inlet chamber 22 and an outlet chamber 24, which communicate only via the relatively narrow annular gap 21 between the periphery of the baffle disk 6 and the interior wall of the rotating drum 8. Its function is to prevent the fluid entering the inlet chamber 22 through the perforations 14' from taking the short way out of the drum 8 through the perforations 14'' of the outlet section 4''. As it is, the fluid is deflected outward and enters the outlet chamber 24 through the aforementioned narrow annular gap 21. It is at this point that the actual separation process begins. The fluid which is progressively assuming the rotational speed of the rotating drum 8, entrained by the latter mostly with the aid of the vanes 20 (FIGS. 1,2), is now increasingly subjected to the effect of the centrifugal force, the more so, the closer it moves to the outlet perforations 16 of the drum 8, where enhanced by the conicity of the drum 8, the surface speed and, thus, the centrifugal force acting on the fluid, is at a maximum. This centrifugal force now has a classifying effect, in that the heavier components of the fluid are impelled to move outward, eventually leaving the rotating drum 8 through the perforations 16 and collecting in the stationary vessel 2 from which they are removed via the discharge outlet 18. The lighter components, on the other hand, are pushed inward by the layers of heavier components crowding near the interior wall of the drum 8, and are forced to leave the outlet chamber 24 through the perforations 14" being removed through the outlet section 4" of the stationary pipe 4. The separation characteristic of the centrifuge is controlled by varying the relative flow rates of the different flows with the aid of the valves 26 and/or 28, and/or by varying the rotational speed of the drum 8.

The aforementioned preferred embodiment of the present invention is particularly useful as a gas separator such as stipulated in Israel Patent No. 54214 which teaches a process for the production of energy from solid hydrocarbon fuels, during a certain stage of which the heavier $CO_2$ is to be separated from a gas mixture containing such lighter gases as $N_2$, $O_2$ and $H_2O$ (steam) and to be recycled to a reactor for reaction with solid hydrocarbon fuel. As this reaction requires for its maintenance much less $CO_2$ than it produces, only part of the $CO_2$ in the mixture need be separated.

Making use of the nomenclature explained below, the Table given in the following lists the main parameters of such a gas separator, as calculated, for a reactor-yielded gas mixture of $CO_2+N_2$, at respective flow rates of $Q_{CO_2}=0.42$ m$^3$/sec and $Q_{N_2}=0.78$ m$^3$/sec, and at specific gravities of $\gamma_{CO_2}=1.965$ kg/m$^3$ and $\gamma_{N_2}=1.257$ kg/m$^3$.

TABLE

Nomenclature used in the Table:

| | | |
|---|---|---|
| Q | = flow rate | m$^3$/sec |
| V | = flow velocity | m/sec |
| d | = diameter | m |
| n | = rotational speed | rpm |
| F | = area filled by flow | m$^2$ |
| $V_2$ | = surface speed at perforation zone of drum | m/sec |

| | Location (with reference to FIG. 3) | | | | | |
|---|---|---|---|---|---|---|
| Parameter | 4' | 14' | 14" | 16 | 4" | 18 |
| Gas | $CO_2$ + $N_2$ | $CO_2$ + $N_2$ | $CO_2$ + $N_2$ | $CO_2$ | $CO_2$ + $N_2$ | $CO_2$ |
| Q | 1.21 | 1.21 | 1.00 | 0.21 | 1.00 | 0.21 |
| V | 9.7 | 8.0 | 8.0 | 12 | 8.0 | 7.0 |
| F* | | 0.151 | 0.125 | 0.018 | | |
| d | 0.4 | | | 1.2 | 0.4 | 0.195 |
| n | | | | 300 | | |
| $V_2$ | | | | 18.84 | | |

*Total area of perforations

As can be seen, 50% of the $CO_2$ is separated, which is exactly what the reactor requires. The remaining $CO_2$—$N_2$ mixture is discharged via the stack. It is, however, quite feasible to utilize also the residual $CO_2$, e.g., for production of dry ice. In this case, a second separator could be used to treat the residual mixture.

If it is desired to prevent the separated fraction from losing too much of its heat content prior to being recycled to the reactor, it is possible to provide the outside of the stationary vessel 2 with heat insulation.

Figure 4:
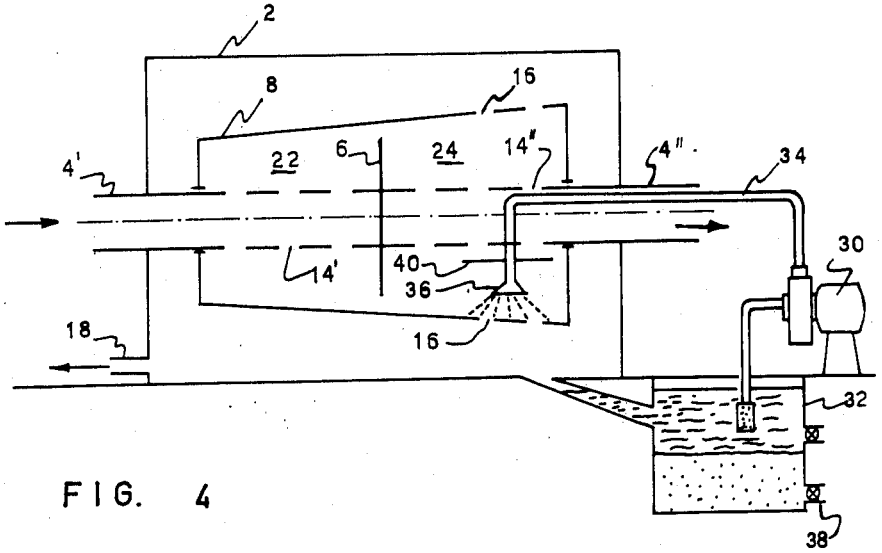
FIG. 4 is a schematic drawing of another embodiment of the centrifuge according to the invention, used as a gas scrubber.

The centrifuge according to the invention can also be used as gas scrubber, e.g., for the scrubbing of dust-polluted air (FIG. 4). To this end, a pump 30 is used to draw liquid from a pit 32 and force it via a pipe line 34 into the outlet chamber 24, where it is atomized by a nozzle 36. Raw air is introduced at 4' and, in analogy to the explanations accompanying FIG. 3, reaches the outlet chamber 24, where the $O_2$- and $N_2$-components are scrubbed prior to entering the perforations 14" and leaving as clean air through 4". Dust is precipitated by the scrubbing action of the liquid spray and is flushed into the pit 32, where it settles and is removed from time to time via the drain pipe 38. The liquid level in the pit is kept constant with the aid of a float arrangement not shown. The heavier $CO_2$-component leaves the drum 8 via the perforations 16 and is removed through the discharge outlet 18. To prevent the scrubbing liquid from entering the outlet section 4", a spray guard 40 is provided, attached to the pipe line 34 upstream of, and at some distance from, the nozzle 36. The liquid used for most types of pollutants is water, but various types of oil or detergents may be used as well.

A similar setup, but not involving the use of the atomizing nozzle 36, can be used for drying excessively humid air. Moisture vapors, having a specific gravity of $\gamma=0.805$ kg/m$^3$, are in fact much lighter than dry air and will therefore either exit via the perforations 14" and the outlet section 4", or condense, reach the bottom of the stationary vessel 2 and drain into the pipe 32. The dried air will be discharged through the discharge outlet 18.

Many types of dustlike pollutants, especially those of low electric resistivity, respond well to the electrostatic precipitation effect which can be used to enhance the separation efficiency of the centrifuge according to the invention. To this end, provision can be made for application of a high electric potential to the rotating drum 8, turning the drum into a discharge electrode, and for grounding of the stationary vessel 2, turning the vessel into a collecting electrode.

Figure 5:
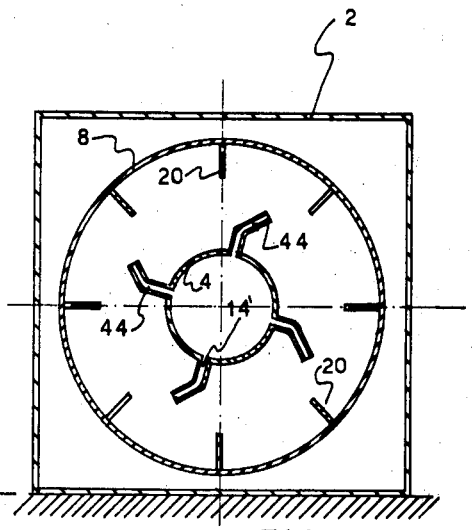
FIG. 5 is a schematic cross-sectional view of a further embodiment of the centrifuge according to the invention.

In FIG. 5 there is shown a further possible embodiment of the centrifuge of FIG. 1 in which to the perforations 14', e.g. circularly shaped perforations, there are attached bent pipes 44 causing a tangential fluid flow along the inside of the drum 8. The fluid which is ejected under pressure through the pipes 44 will impinge upon the vanes 20, thereby imparting a rotary motion to the drum 8. In this case the drive means 12 of FIG. 1 may be dispensed with, however, a pump (not shown) may be required to introduce the fluid into the pipe 4 under sufficient high pressure for effecting the desired rotary motion. In some of the envisioned uses of this device, for example, when the centrifuge is utilized in planes, rockets and the like, such high pressures can be obtained from the external air which may be directed to enter the pipe 4.

Figure 6:
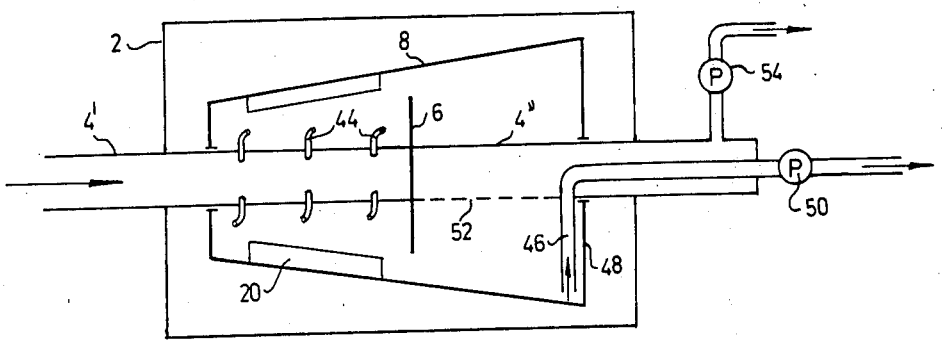
FIG. 6 is a schematic drawing of still another embodiment particularly adapted for treating liquids.

FIG. 6 shows yet another embodiment of the centrifuge according to the invention, which is particularly suitable for separating liquid mixtures. While the left half of the device is essentially identical in design and operation to that shown in FIG. 5, the outlet section 4" of the stationary pipe 4 is provided at its inside with a suction tube 46, one end of which reaches into a zone close both to the wall of the rotatable drum 8 and to its larger end plate 48, the other end of this tube 46 being connected to a pump 50 for the removal of the heavier component. The outlet section 4'' of the stationary pipe 4 is provided with perforations 52 at least on its lower side and, at its free end, is connected to a pump 54 for the removal of the lighter component.

In another version of this embodiment, (not shown) the outlet section 4'' of the stationary pipe 4, instead of the perforations 52, is provided with a second suction tube, one end of which, also reaches into the drum, but to a depth substantially less than the depth of reach of the first suction tube 48. The other end of this second suction tube leads into the outlet section 4'' of the stationary pipe 4, the lighter component being drawn off by the pump 54, as in the previous version. Both versions work according to the centrifuging principle, whereby, with the drum rotating, the heavier component seeks to attain the greatest possible distance from the axis of rotation, thereby collecting close to the wall 8 as well as to the larger end plate 48, whence it is drawn off through the tube 46. The lighter component is pushed inward, to be drawn off, in the first version, through the perforations 52 or, in the second version, through the second suction tube.

It will be evident to those skilled in the art that the invention is not limited to the details of the foregoing illustrative embodiment and that the present invention may be embodied in other specific forms without departing from the essential attributes thereof, and it is, therefore, desired that the present embodiments be considered in all respects as illustrative and not restrictive, reference being made to the appended claims, rather than to the foregoing description, and all changes which come within the meaning and range of equivalency of the claims are, therefore, intended to be embraced therein.

What is claimed is:

1. A centrifuge for treatment of fluids, comprising a stationary vessel, a stationary pipe passing through said stationary vessel, a baffle disk fixedly mounted on said stationary pipe, a rotating drum mounted on and rotatable about said stationary pipe inside said stationary vessel and divided by said baffle disk into an inlet chamber and an outlet chamber, which outlet chamber is provided with outlet means, further comprising drive means to impart a rotary motion to said drum, wherein said statinary pipe is divided into two mutually sealed-off sections, an inlet section and an outlet section, both of which pipe sections are perforated over that part of their respective length, which is located within said rotating drum, the arrangement being such that upon the introduction of a multicomponent fluid into the inlet section of said stationary pipe, said fluid disperses into the interior of said rotating drum through said perforations in said inlet sections and, being entrained by the inside surfaces of said rotating drum, said fluid is affected by centrifugal forces, due to which forces the heavier components of said fluid are caused to migrate toward the periphery of said drum to exit via said outlet means, while the lighter components of said fluid are displaced toward the perforations of the outlet section of said stationary pipe, through which perforations said lighter components are drawn into said outlet section to be removed therefrom.

2. The centrifuge as claimed in claim 1, wherein a zone of the drum periphery at that end of said drum which is remote from said inlet section is also perforated, and wherein said stationary vessel is provided with a discharge outlet at a point close to its bottom.

3. The centrifuge as claimed in claim 2, wherein the heavier components of said fluid are caused to migrate toward the periphery of said drum and to enter said stationary vessel via the perforations in said zone, from which stationary vessel said heavier components are then removed.

4. The centrifuge as claimed in claim 1, wherein said rotating drum is in the shape of a truncated cone having one larger and smaller end plate, said fluid is a multicomponent liquid and the outlet section of said stationary pipe is provided at its inside with at least a first suction tube, one end of which reaches into a zone close to the wall of said rotatable drum on the one hand, and close to the larger end plate of said drum on the other, while the other end of said tube is connected to a pump for the removal of the heavier component, and wherein the outlet section of said stationary pipe is provided with one or more perforations at least on its underside and with a pump at its free end for the removal of the lighter component.

5. The centrifuge as claimed in claim 1, wherein said rotating drum is in the shape of a truncated cone.

6. The centrifuge as claimed in claim 1, wherein the interior wall of said rotating drum is provided with a plurality of vanes attached to said interior wall substantially along generatrices of said drum and extending into said drum in a substantially radial direction.

7. The centrifuge as claimed in claim 6, wherein said drive means for imparting a rotary motion to said drum are a plurality of pipes attached to and extending from at least some of the perforations of said stationary pipe whereby a fluid flow, tangential to the inside of the drum and impinging upon the vanes, is formed, thereby imparting the rotary motion to the drum.

8. The centrifuge as claimed in claim 1, further comprising means for the introduction of a liquid into said outlet chamber, to be atomized therein for the purpose of gas scrubbing and guard means to prevent said scrubbing liquid from entering the outlet section of said stationary pipe.

* * * * *